United States Patent [19]

Todd

[11] Patent Number: 4,828,260

[45] Date of Patent: May 9, 1989

[54] RACQUET VIBRATION ABSORBING DEVICE

[75] Inventor: Barry A. H. Todd, Mosman, Australia

[73] Assignee: Fin Sports Limited, Aylesbury, England

[21] Appl. No.: 235,774

[22] Filed: Aug. 23, 1938

Related U.S. Application Data

[63] Continuation of Ser. No. 918,445, Oct. 14, 1986, abandoned.

[30] Foreign Application Priority Data

Oct. 11, 1985 [AU] Australia ..... PH2864

[51] Int. Cl.[4] ..... A63B 49/02

[52] U.S. Cl. ..... 273/73 C; 273/73 G

[58] Field of Search ..... 273/73 R, 73 C, 73 G, 273/73 D, 73 L, 73 F

[56] References Cited

U.S. PATENT DOCUMENTS

| | | | |
|---|---|---|---|
| 3,814,423 | 6/1974 | Shockley et al. | 273/73 G |
| 4,311,308 | 1/1982 | Völki et al. | 273/73 G |

FOREIGN PATENT DOCUMENTS

| | | | |
|---|---|---|---|
| 553218 | 12/1986 | Australia . | |
| 2211857 | 7/1974 | France | 273/73 G |
| 10867 | of 1887 | United Kingdom | 273/73 G |
| 4645 | of 1913 | United Kingdom | 273/73 C |

*Primary Examiner*—Leo P. Picard
*Assistant Examiner*—Jessica J. Harrison
*Attorney, Agent, or Firm*—Sixbey, Friedman, Leedom & Ferguson

[57] ABSTRACT

An improved sports racquet of the type having a rounded head for holding an array of tensioned strings, a shaft with a handle, and a yoke including a pair of bifurcated arms for attaching the shaft to the head, wherein the improvement generally comprises a resilient insert disposed within a radially disposed gap provided completely through the racquet head between the two arms of the yoke. The resilient insert is keyed to fit closely within the gap in the racquet head, and is further secured in place by a base plate which overlies the confronting ends of the head formed by the gap. The resilient insert absorbs head vibration by cushioning flexure in the head which tends to either narrow the gap in the head, or misalign the two confronting ends of the head.

10 Claims, 3 Drawing Sheets

RACQUET VIBRATION ABSORBING DEVICE

This application is a continuation of application Ser. No. 918,445, filed Oct. 14, 1986, now abandoned.

BACKGROUND OF THE INVENTION

This invention relates to racquets, and more particularly to strung racquets of the kind utilised in such games as tennis, squash racquets, racquet ball and other sports.

A common feature of these racquets is that they are tightly strung for imparting driving power to a ball while the frame should have a degree of resiliency and be of light-weight construction Racquet frames composed entirely of graphite, or of graphite/fibreglass or even metal, have become popular because of the strength of the material. However, graphite is a material relatively susceptible to damage when subjected to impacting forces which can occur by misuse, or even with normal usage with a high-powered stroke where the ball strikes the racquet off-centre. Frequently, also, jarring of the racquet under these conditions is transmitted through the frame to the arm of the user which over a period of time can result in injury.

SUMMARY OF THE INVENTION

It is an object of the invention to provide a racquet incorporating means for absorbing forces created by impacts.

Accordingly this invention consists in a strung racquet comprising a head supported at spaced positions upon opposite arms of a yoke, said head having a gap between the yoke arms, and an insert of resilient material positioned within the gap to cushion flexure in the head tending to narrow the gap.

For preference, the confronting ends of the head defining the gap are keyed into the insert to cushion flexure in the head tending to cause misalignment of the confronting ends. The ends are preferably keyed into the insert by fitting into sockets formed in the insert. The sockets can be of any suitable shape, for example arcuate or of truncated V-shape. The socket can, in one embodiment, be formed wholly or partially by the insert overlapping the sides of the head adjacent the confronting ends.

The insert can be held in place entirely by the force exerted by the opposing ends when the racquet is strung or by any other suitable means. For example, a base plate can be positioned adjacent the outer periphery of the head to hold the insert in position. The base plate can be separate or integrally formed with the insert. In addition the base plate can be provided with two or more holes through which the string of the racquet passes to hold the base plate in position.

BRIEF DESCRIPTION OF THE SEVERAL FIGURES

The invention will be described in more detail with reference to the accompanying drawings, in which.

The drawings show the application of the invention to a squash racquet but it will be clear from an understanding of the following description that it may be applied just as readily to other forms of strung racquets such as those used in the game of tennis, racquet ball, badminton, etc.

DETAILED DESCRIPTION OF THE PREFERRED EMBODIMENTS

Figures 1, 2, 3:
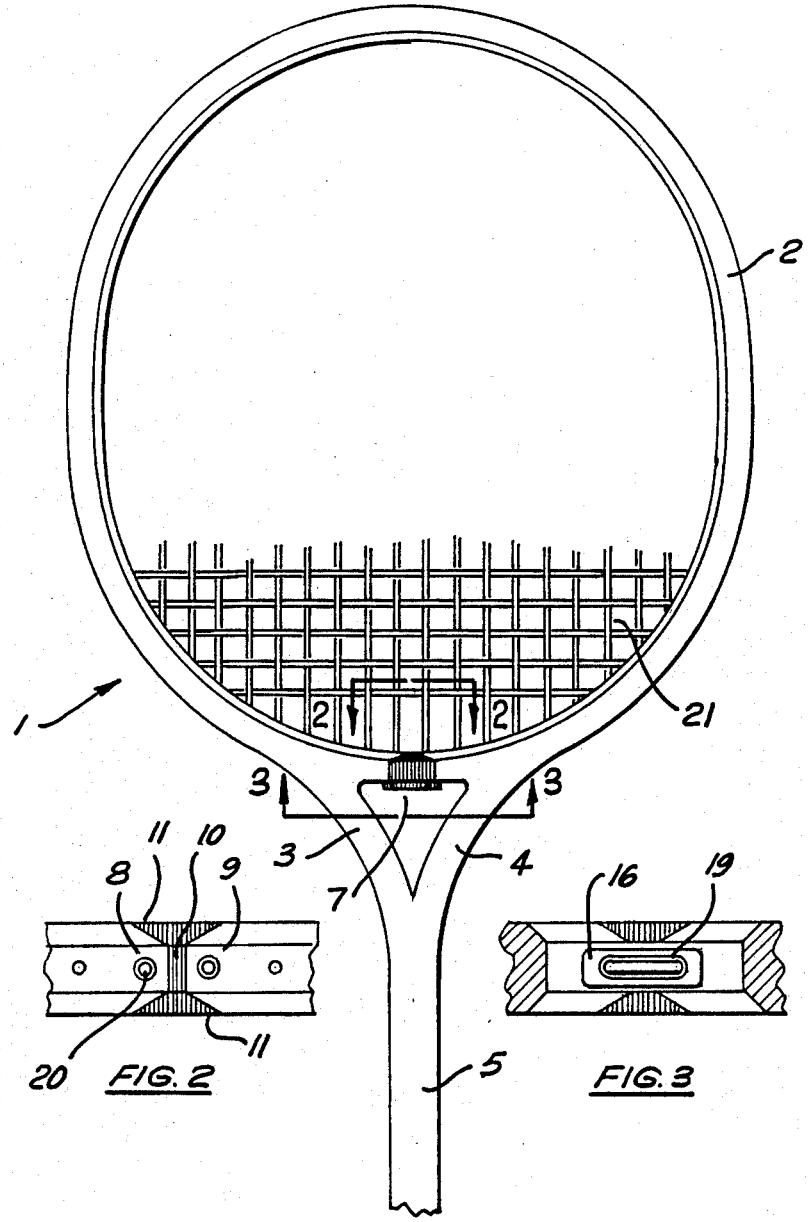
FIG. 1 is a side view of a strung racquet according to the invention.
FIG. 2 is a part sectional view along the line 2—2 of FIG. 1.
FIG. 3 is a part sectional view along the line 3—3 of FIG. 1.
Figure 6:
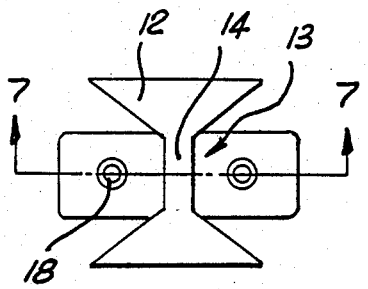
FIG. 6 is a plan view of the insert of FIG. 4.
Figure 4:
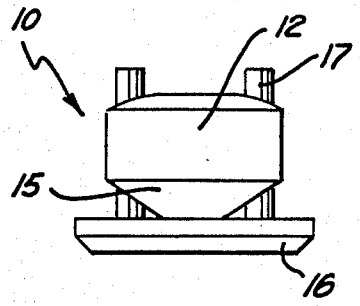
FIG. 4 is a side view of a vibration absorbing insert forming part of the racquet of FIG. 1.
Figure 5:
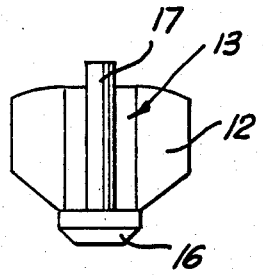
FIG. 5 is an end view of the insert of FIG. 4.
Figure 7:
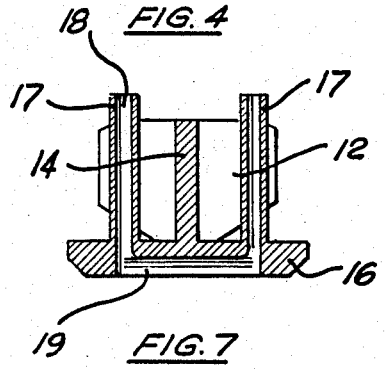
FIG. 7 is a sectional view along the line 7—7 of FIG. 6.
Figure 10:
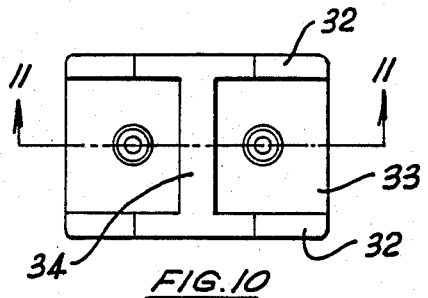
FIG. 10 is a plan view of the insert of FIG. 8.
Figure 8:
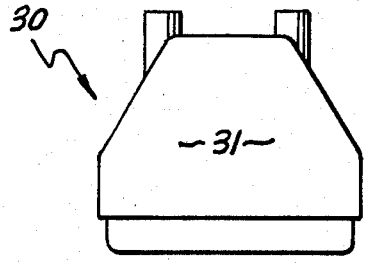
FIG. 8 is a side view similar to FIG. 4 showing a second embodiment of the vibration absorbing insert.
Figure 9:
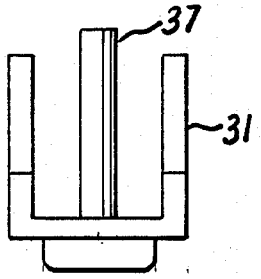
FIG. 9 is an end view of the insert of FIG. 8.
Figure 11:
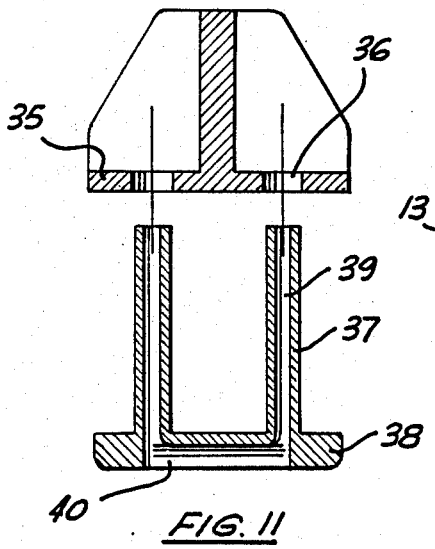
FIG. 11 is a sectional view along the line 11—11 of FIG. 10.

With reference to FIGS. 1 to 3 it will be observed that racquet 1 has a frame composed of a head 2 supported upon integrally formed opposite arms 3 and 4 of a yoke integral with a shaft 5 terminating in a hand grip, or handle, (not shown). The racquet frame may be composed entirely of graphite, or graphite together with other fibres, or even metal.

In accordance with the invention the head 2 at a position equally spaced between the yoke arms 3 and 4 is provided with a gap 7 which for example can be created by a single straight cut through the head 2, the gap 7 is defined by confronting ends 8, 9. The confronting ends 8, 9 are bevelled on each side at 11 and a close-fitting insert 10, as more particularly shown in FIGS. 4 to 7, is introduced into the gap 7 to cushion flexure in the head 2 tending to cause narrowing of the gap 7 or misalignment of the confronting ends 8 and 9 of the head 2.

The keying is effected by the bevelled confronting ends 8, 9 neatly fitting into the truncated V-shaped sockets 13. Flexure tending to cause misalignment is thus opposed by the resilience of the insert 10.

The insert 10 has a main body 12 generally of hour glass shape when viewed in plan, achieved by providing lateral recesses 13 or sockets of truncated V-shape producing a narrow waist section 14. The cushioning of flexure tending to cause misalignment is achieved by keying confronting ends 8, 9 into the insert 10. The underside of the body 12 is connected by a tapering stem 15 to a narrow base 16. A pair of spigots 17 provided with bores 18 are upstanding from the base 16 and extend through respective ones of the sockets 13. An elongated recess 19 in the underside of the base 15 interconnects the bores 18 of the spigots 17.

As can be seen from FIGS. 1 and 2 the ends 8 and 9 of the head 2 closely adjacent the gap 7 are provided with stringing holes 20. The insert 10 is introduced to the gap 7 from the outside of the head 2 so that the spigots 17 pass through the string holes 20. The bevelled ends 8 and 9 of the head 2 are snuggly accommodated within the truncated V-shaped sockets 13 of the insert 10. When the racquet frame is strung with gut 21, or other material, a string is passed downwardly through the bore 18 of one of the spigots 17, along the recess 19 of the base 16 and upwardly through the bore 18 of the other spigot 17. When the string 21 is drawn taut the insert 10 is tightly held within the gap 7. It will be noted that due to the matching shape of the recesses 13 of the insert 10 and the ends 8 and 9 of the head 2, cushioning of impact forces tending to narrow the gap 7 will be achieved by the resiliency in the waist section 14, while forces tending to misalign the ends 8 and 9 will be resiliently restrained by the body 12 of the insert 10.

FIGS. 8 to 11 show a second embodiment of an insert for use in the racquet described with reference to FIGS. 1 to 3. The insert 30 of the second embodiment has a main body 31 of a generally H-shape when viewed in plan. Sides 32 define two sockets 33 separated by a waist portion 34. The underside of the body 31 joins an integrally formed floor 35 which extends between sides 32. Apertures 36 are formed in floor 35 to receive a pair of spigots 37 upstanding from a base plate 38. Spigots 37 are provided with bores 39 and an elongated recess 40 in the underside of base plate 38 interconnects the open ends of the bores.

With the insert 30 of this embodiment the confronting ends 8, 9 of the head 2 are not bevelled but are flat. The confronting ends 8, 9 are keyed into the insert 30 by snuggly fitting into sockets 33 with the sides 32 of the insert 30 overlapping the sides of the head 2 adjacent the confronting ends 8, 9.

In use the body of insert 30 is introduced into the gap 7 from the outside of the head 2. The apertures 36 are aligned with string holes 20 and the spigots 37 on base plate 38 inserted through the apertures and string holes until the base plate 38 abuts floor 35. The racquet is then strung in the manner described above for the insert of the first embodiment. As with the first embodiment described above cushioning of impact forces tending to narrow the gap 7 is achieved by resiliency in the waist section. Forces tending to misalign the confronting ends 8, 9 are in this embodiment resiliently restrained by the sides 32 of insert 30.

Figure 12:
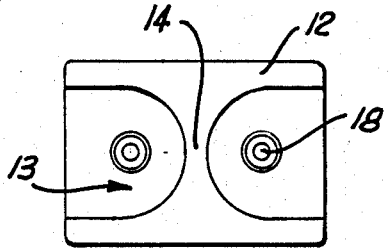
FIG. 12 is a side view similar to FIGS. 4 and 8 showing a third embodiment of the vibration absorbing insert.

FIG. 12 shows a third embodiment of an insert for use in the racquet described with reference to FIGS. 1 to 3. The insert closely resembles that depicted in FIGS. 4 to 7 and the same reference numerals have been used to depict like features. In the FIG. 12 arrangement the recess or socket 13 is arcuately shaped instead of being formed in a truncated V-shape. With the FIG. 12 insert, the confronting ends 8, 9 of head 2 are correspondingly arcuately shaped to snuggly fit into sockets 13. The fitting of the insert and the manner in which cushioning is achieved are otherwise identical to that described above in relation to FIGS. 4 to 7.

A particularly suitable material for the resilient insert is a plastics material known as Dupont ST-801.

It has been found that a racquet constructed according to this invention has been successful in absorbing nearly all of the harmful frame vibration inherent in strong racquets. It seems that by separating the yoke into individual arms and the vibration created by impact forces appears to be attracted to this area of the racquet and is absorbed to a large extent in the insert. String vibration, or what is commonly referred to as the "feeling" in the racquet continues to be transmitted to the user without substantial attenuation. It is not commonly realised that frame vibration is what apparently causes arm and shoulder injury to a user, as opposed to string vibration to which most attention has previously been applied. Furthermore, should the racquet be struck against a hard surface, it has been found that a racquet provided with the insert of this invention is more durable than one of conventional form.

The claims defining the invention are as follows:

I claim:

1. An improved string racquet of the type including a rounded, continuous head having a plurality of spaced holes disposed around it periphery for conducting tensioned racquet strings, and a yoke means having a pair of opposing arms for radially connecting a shaft to the head, a portion of said continuous head being supported between the opposing arms of said yoke, wherein the improvement comprises the provision of a radially disposed gap in the portion of said head disposed between said yoke arms that extends completely through said head and defines two spaced, unconnected confronting head ends, and a resilient insert closely disposed between the two spaced, unconnected confronting head ends for cushioning flexure in the head and thereby absorbing head vibration.

2. An improved string racquet as defined in claim 1, wherein the insert includes a waist section for cushioning flexure tending to narrow said gap, and a body for restraining forces tending to misalign the confronting head ends.

3. An improved string racquet as defined in claim 1, wherein said resilient insert includes recesses for receiving the confronting ends of the head in order to key said insert into said gap.

4. An improved string racquet as defined in claim 3, wherein said recesses are truncated V-shaped sockets, and said confronting head ends have bends complementary in shape to said sockets.

5. An improved string racquet as defined in claim 3, wherein said recesses are rectangular and complementary in shape to the confronting ends of the head.

6. An improved string racquet as defined in claim 3, wherein said recesses are arcuate and complementary in shape to the confronting ends of the head.

7. An improved string racquet as defined in claim 3, wherein said recess is formed by portions of the insert that overlap the sides of the head adjacent the confronting ends.

8. An improved string racquet as defined in claim 1, wherein said improvement further comprises a base plate positioned on a peripheral portion of the head adjacent to the insert for securing said insert in the head.

9. An improved string racquet as defined in claim 8, wherein said base plate is provided with at least two holes for conducting at least one tensioned string so that said string secures said plate to said head.

10. An improved string racquet of the type including a rounded, continuous head having a plurality of spaced holes disposed around its periphery for conducting tensioned racquet strings, and a yoke having a pair of bifurcated arms, each of which is connected to a different portion of the periphery of the head for mounting a shaft onto the head, wherein the improvement comprises a. the provision of a radially disposed gap in said head located between said yoke arms which extends completely therethrough and defines two spaced, unconnected confronting head ends;

b. A resilient insert disposed in said gap having a waist section for cushioning flexure tending to narrow said gap, and a body for restraining forces tending to misalign the confronting head ends, thereby absorbing head vibration, wherein said insert is keyed within said gap, and includes recesses for receiving the spaced, unconnected confronting ends of the head.

* * * * *